US010084291B2

(12) United States Patent
Carlson et al.

(10) Patent No.: US 10,084,291 B2
(45) Date of Patent: Sep. 25, 2018

(54) IGNITION COIL BEING ADJUSTABLE TO ACCOMMODATE DIFFERENT MOUNTING ENVIRONMENTS

(71) Applicant: DELPHI TECHNOLOGIES IP LIMITED, St. Michael (BB)

(72) Inventors: Joseph R. Carlson, Berkley, MI (US); Mialy Shrady, Troy, MI (US); Carl R. Morganti, Rochester, MI (US)

(73) Assignee: DELPHI TECHNOLOGIES IP LIMITED (BB)

( * ) Notice: Subject to any disclaimer, the term of this patent is extended or adjusted under 35 U.S.C. 154(b) by 360 days.

(21) Appl. No.: 14/887,699

(22) Filed: Oct. 20, 2015

(65) Prior Publication Data

US 2017/0110855 A1 Apr. 20, 2017

(51) Int. Cl.

| | |
|---|---|
| ***H01T 15/00*** | (2006.01) |
| ***F02P 3/04*** | (2006.01) |
| ***F02P 15/00*** | (2006.01) |

(52) U.S. Cl.

CPC ..... *H01T 15/00* (2013.01); *F02P 3/04* (2013.01); *F02P 15/00* (2013.01)

(58) Field of Classification Search

CPC ..... H01T 15/00; F02P 3/04; F02P 15/00

See application file for complete search history.

(56) References Cited

U.S. PATENT DOCUMENTS

| | | | | |
|---|---|---|---|---|
| 4,033,641 | A * | 7/1977 | Cain | F16C 23/00 384/207 |
| 4,715,337 | A | 12/1987 | Bohl et al. | |
| 5,971,776 | A | 10/1999 | Neel et al. | |
| 7,928,821 | B2 * | 4/2011 | Matsubayashi | H01F 38/12 123/634 |
| 9,117,585 | B2 | 8/2015 | Skinner et al. | |
| 2003/0117248 | A1 | 6/2003 | St. John et al. | |
| 2006/0164196 | A1 | 7/2006 | Skinner et al. | |
| 2009/0183558 | A1 * | 7/2009 | Houjie | G01D 11/245 73/114.26 |
| 2012/0161604 | A1 | 6/2012 | Lykowski et al. | |
| 2015/0167622 | A1 | 6/2015 | Skinner et al. | |

FOREIGN PATENT DOCUMENTS

| | | | |
|---|---|---|---|
| EP | 1457671 | A1 | 9/2004 |
| JP | 2003049740 | A | 2/2003 |

* cited by examiner

*Primary Examiner* — Scott Bauer
(74) *Attorney, Agent, or Firm* — Joshua M. Haines

(57) ABSTRACT

An ignition coil includes a circuit which generates a spark-generating current; a case within which the circuit is disposed; and a mounting boss attached to the case such that the mounting boss is rotatable relative to the case about a mounting boss axis, the mounting boss being configured to mount the ignition coil.

25 Claims, 3 Drawing Sheets

IGNITION COIL BEING ADJUSTABLE TO ACCOMMODATE DIFFERENT MOUNTING ENVIRONMENTS

TECHNICAL FIELD OF INVENTION

The present invention relates to an ignition coil for developing a spark-initiating current for a spark plug; and more particularly to such an ignition coil that is adjustable to accommodate a variety of mounting environments.

BACKGROUND OF INVENTION

Internal combustion engines that utilize spark ignition combustion processes commonly include an ignition coil that is dedicated to a single spark plug. The ignition coil is used to develop a spark-initiating current that is sent to the spark plug, thereby allowing the spark plug to generate a spark which initiates combustion of a fuel and air mixture within a combustion chamber of the internal combustion engine. The ignition coil has three basic interfaces with the internal combustion engine: 1) a mounting boss which typically receives a fastener to clamp the ignition coil to the internal combustion engine, 2) a low-voltage connector body which mates with a mating connector of the internal combustion engine to power the ignition coil, and 3) a high-voltage tower which engages the spark plug and contains a conductor which delivers the spark-initiating current to the spark plug. A case of the ignition coil contains a circuit typically comprising a magnetically permeable core, a primary winding, and a secondary winding such that the mounting boss, low-voltage connector body, and high-voltage tower are secured to the case in a fixed relationship. In operation, a low voltage current is applied to the primary winding. The secondary winding is inductively coupled to the primary winding such that when the low voltage current to the primary winding is stopped by opening a switch, a high-voltage current is generated in the secondary winding which is passed to the spark plug. Ignition coils that have fixed geometries between the mounting boss, the low-voltage connector body, and the high-voltage tower are convenient to use in environments which produce internal combustion engines in high-volume, however, in service environments, i.e. automotive parts stores, service centers, automotive dealerships, and the like, it can be burdensome to maintain stock of the variations of ignition coils that are needed to service the variety of internal combustion engines that have been produced. Consequently, in order to minimize stock in a service environment, it would be more convenient to consolidate ignition coils that have equivalent circuits but different geometry between the mounting boss, the low-voltage connector body, and the high-voltage tower. This consolidation of ignition coils would provide for higher manufacturing volumes that would enable the manufacturer to keep a supply of service parts available longer, maintain higher quality, and be more cost effective for both the manufacturer and the customers.

In one known arrangement, an ignition coil is provided with a collapsible high-voltage tower which is initially at an extended position and is moved to a retracted position as the ignition coil is assembled to the internal combustion engine. However, the extent of adjustment of the high-voltage tower is two distinct lengths. Furthermore, the collapsible high-voltage tower does not make accommodations for differing geometric relationships of the mounting boss relative to the low-voltage connector body or orientation of the connector body.

What is needed is an ignition coil which minimizes or eliminates one or more of the shortcomings as set forth above.

SUMMARY OF THE INVENTION

Briefly described, an ignition coil is provided for delivering a spark-generating current to a spark plug. The ignition coil includes a circuit which generates the spark-generating current; a case within which the circuit is disposed; and a mounting boss attached to the case such that the mounting boss is rotatable relative to the case about a mounting boss axis, the mounting boss being configured to mount the ignition coil.

In another aspect, the ignition coil may also include a connector body which houses an electrical terminal which is in electrical communication with the circuit, the connector body being attached to the case such that the connector body articulates relative to the case.

In yet another aspect, the ignition coil may also include a high-voltage tower having a high-voltage tower upper portion attached to the case and extending along an upper portion axis, the high-voltage tower also having a high-voltage tower lower portion configured to engage the spark plug and extending from the high-voltage tower upper portion along a lower portion axis, the high-voltage tower upper portion being attached to the high-voltage tower lower portion by a joint which allows the lower portion axis to articulate relative to the upper portion axis.

In still yet another aspect, the high voltage tower may include a fixed portion and a telescoping portion such that said fixed portion and said telescoping portion extend along a tower axis and such that said telescoping portion is configured to slide relative to said fixed portion along said tower axis.

Rotation of the mounting boss relative to the case, articulation of the connector body relative to the case, articulation of the high-voltage tower, and telescoping of the high-voltage tower allows the ignition coil to adapt to different mounting environments, thereby allowing the ignition coil to replace several ignition coils that differ in their mounting configurations.

BRIEF DESCRIPTION OF DRAWINGS

This invention will be further described with reference to the accompanying drawings in which.

DETAILED DESCRIPTION OF INVENTION

Figure 1:
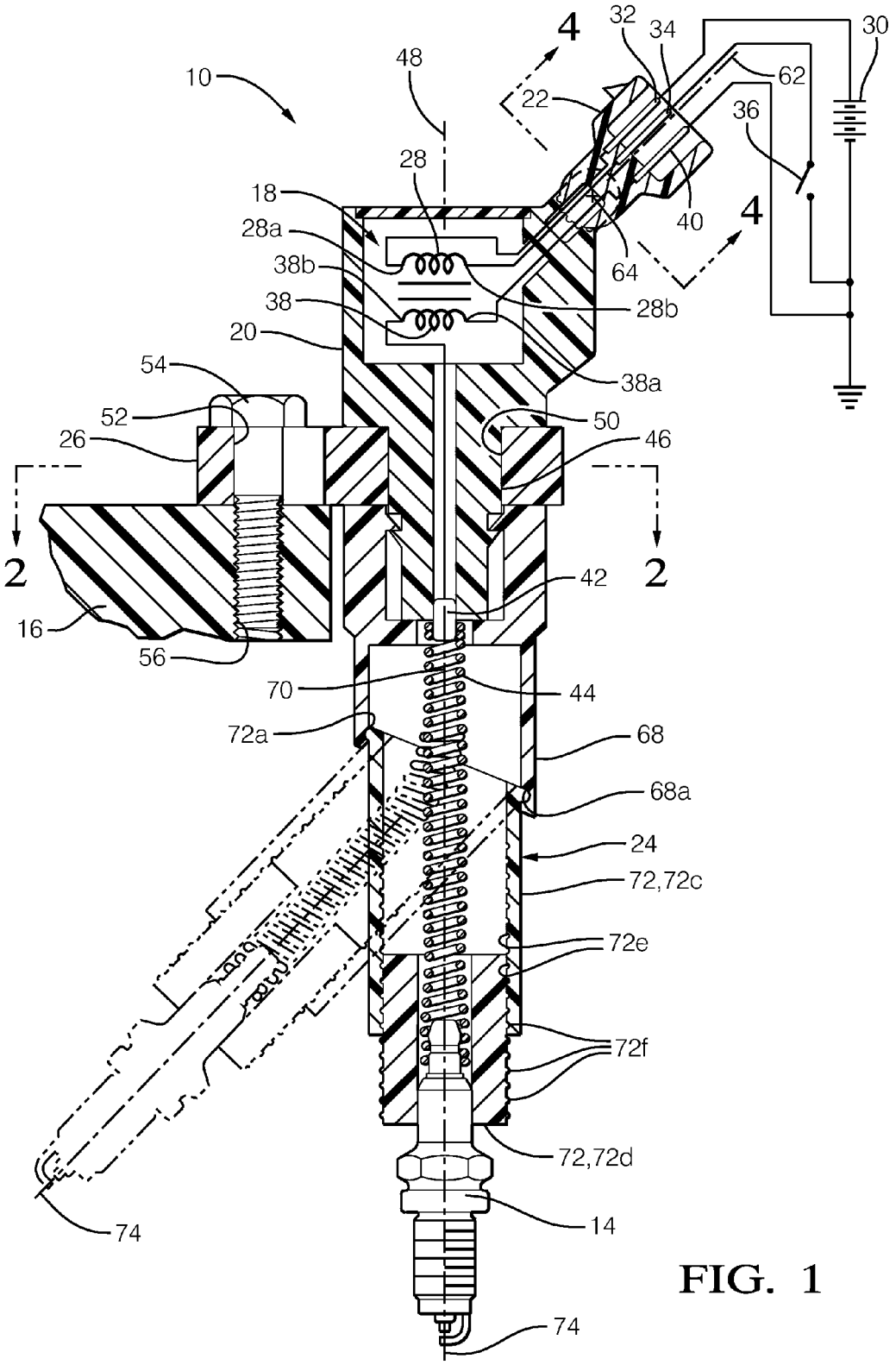
FIG. 1 is a simplified cross-sectional view of an ignition coil in accordance with the present invention.

Referring now to the drawings wherein like reference numerals are used to identify identical components in the various views, a simplified ignition coil 10 in accordance with the present invention is shown. Ignition coil 10 may be controlled by a control unit (not shown) or the like. Ignition coil 10 is configured for connection to a spark plug 14 that is in threaded engagement with a spark plug opening (not shown) in an internal combustion engine 16. Ignition coil 10 is configured to produce a high-voltage output to spark plug 14, as shown. Generally, overall spark timing (dwell control) and the like is provided the control unit. Internal combustion engine 16 may include a plurality of spark plugs 14 and one ignition coil 10 may be provided for each spark plug 14.

Ignition coil 10 includes a circuit 18 which is shown in simplified schematic form as will be described in greater detail later. Circuit 18 is disposed within a case 20 which includes a low-voltage connector body 22, a high-voltage tower 24, and a mounting boss 26, all of which will be described in greater detail later.

Circuit 18 includes a primary winding 28 having a primary winding first end 28*a* connected to a voltage source 30 via a positive terminal 32 located in low-voltage connector body 22. By way of non-limiting example only, voltage source 30 may be a battery of a motor vehicle. Primary winding 28 also include a primary winding second end 28*b* which is selectively connected to ground via a ground terminal 34 located in low-voltage connector body 22 and also via a switch 36 located between ground terminal 34 and ground. Primary winding 28 may comprise copper, insulated magnet wire, with a size typically between about 20-26 AWG which is wound around a primary winding spool (not shown).

Circuit 18 also includes a secondary winding 38 having a secondary winding low-voltage end 38*a* connected to ground via a ground terminal 40 located in low-voltage connector body 22. Alternatively, secondary winding low-voltage end 38*a* may be connected to positive battery voltage. Secondary winding 38 also has a secondary winding high-voltage end 38*b* which is connected to spark plug 14 via a high-voltage terminal 42 located within case 20 and a high-voltage conductor 44 located primarily within high-voltage tower 24. Secondary winding 38 may be implemented using copper, insulated magnet wire which is wound around a secondary winding spool (not shown).

Secondary winding 38 is inductively coupled to primary winding 28. Consequently, when switch 36 is closed, a path to ground is established through primary winding 28, thereby establishing a current through primary winding 28. When switch 36 is thereafter opened, the current through primary winding 28 is interrupted, thereby causing a relatively high voltage to be produced across secondary winding 38 and delivering a spark-generating current to spark plug 14. It should be understood that additional elements of circuit 18 may be implemented in customary fashion, for example a magnetically-permeable core which is surrounded by primary winding 28 and a magnetically-permeable structure which provides a magnetic return path may typically be provided. Circuit 18 and variations thereof are well known to those skilled in the art of ignition coils and will not be described in greater detail herein; however, further details of exemplary circuits are described in United States Patent Application Publication Nos. US 2006/0164196 and US 2015/0167622 and U.S. Pat. No. 9,117,585; all of which are to Skinner et al. and all of which are hereby incorporated herein by reference in their entireties.

In the paragraphs that follow, features of case 20, mounting boss 26, low-voltage connector body 22, and high-voltage tower 24 will be described which allow ignition coil 10 to accommodate different mounting environments.

Figure 2:
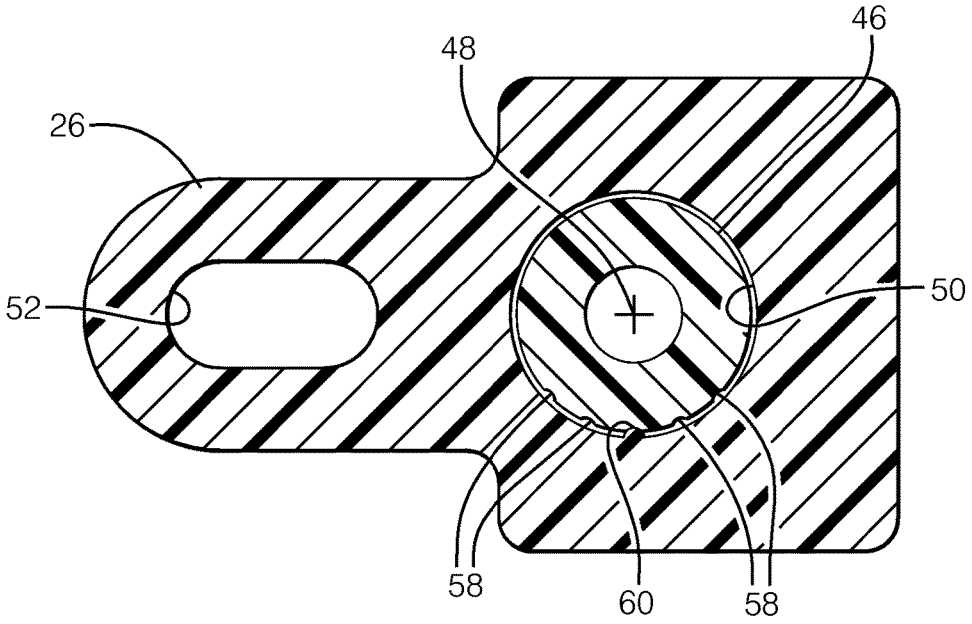
FIG. 2 is a cross-section view of the ignition coil taken through section line 2-2 of FIG. 1.

Case 20 includes a case pivot 46 having a constant radius which is centered about a mounting boss axis 48. As shown, case pivot 46 may be cylindrical; however, case pivot 46 may alternatively be a constant radius for less than 360°. Mounting boss 26 includes a complementary mounting boss pivot 50 having a constant radius which is centered about mounting boss axis 48 and which is radially adjacent to case pivot 46. As shown, mounting boss pivot 50 may be defined by a cylindrical aperture extending through mounting boss 26. However, mounting boss pivot 50 may be a constant radius for less than 360°, for example, by being defined by a fork-shaped opening extending through mounting boss 26. Mounting boss 26 also includes a mounting aperture 52 extending through mounting boss 26. Mounting aperture 52 is configured to receive a fastener, illustrated as mounting bolt 54, which is used to secure ignition coil 10 to internal combustion engine 16, for example, by threadably engaging a complementary threaded aperture 56 in internal combustion engine 16. Alternatively, by way of non-limiting example only, the fastener may be a screw, a threaded stud and complementary nut, a rivet or the like. As shown, mounting aperture 52 may extend through mounting boss 26 in a direction substantially parallel to mounting boss axis 48 in an offset relationship to mounting boss axis 48. Mounting aperture 52 may be elongated, i.e. a slot, in a radial direction relative to mounting boss axis 48 as shown in order to accommodate different distances between mounting boss axis 48 and threaded aperture 56. As used herein elongated means that mounting aperture 52 has a greater dimension radially relative to mounting boss axis 48 compared to the dimension of mounting aperture 52 that is perpendicular to the dimension radially relative to mounting boss axis 48. Case pivot 46 and mounting boss pivot 50 are sized to allow rotation of mounting boss 26 relative to case 20. Case pivot 46 and mounting boss pivot 50 may be further sized to provide a friction fit between case pivot 46 and mounting boss pivot 50 which substantially prevents rotation of mounting boss 26 relative to case 20 in operation of ignition coil 10, however, the friction fit allows a person that is installing ignition coil 10 on internal combustion engine 16 to position mounting boss 26 relative to case 20 to a desired orientation by rotating mounting boss 26 relative to case 20 about mounting boss axis 48. In addition to or in the alternative as shown in FIG. 2, case pivot 46 may include a plurality of circumferentially spaced recesses 58 which are each configured to receive a complementary protrusion 60 extending from mounting boss pivot 50. In this way, recesses 58 provide discrete positions to hold mounting boss 26 relative to case 20. It should be understood that recesses 58 and protrusions 60 may reversed, that is, recesses 58 may be provided in mounting boss pivot 50 while protrusion 60 may be provided on case pivot 46.

Figure 3:
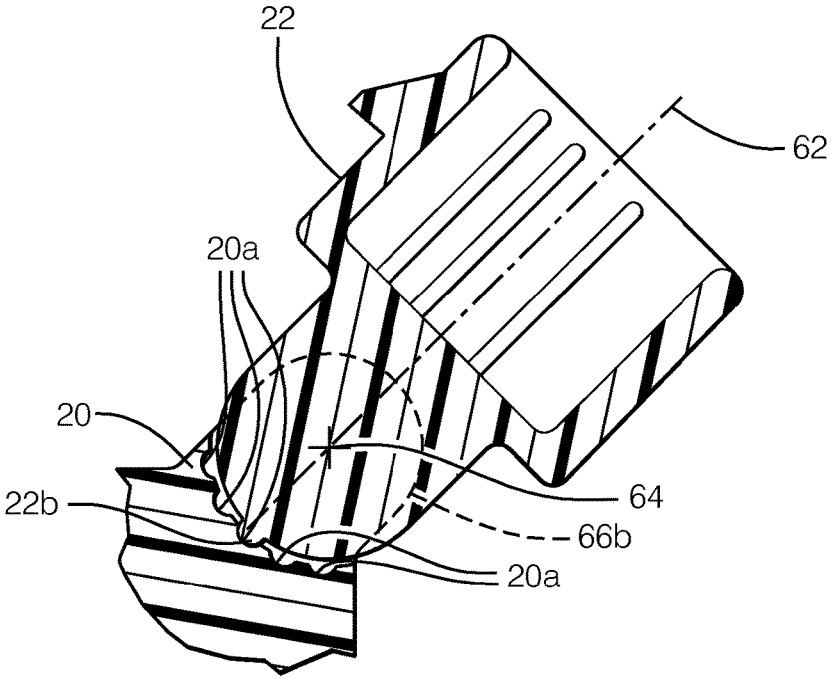
FIG. 3 is a cross-sectional view of a portion of the ignition coil taken through section line 3-3 of FIG. 4.
Figure 4:
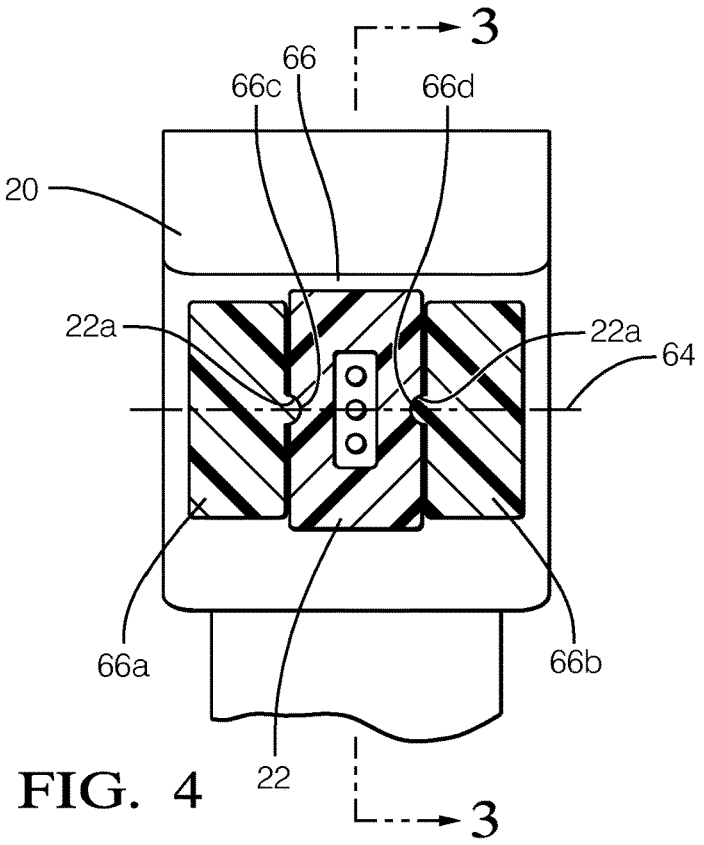
FIG. 4 is a cross-sectional view of a portion of the ignition coil taken through section line 4-4 of FIG. 1.

Low-voltage connector body 22 extends along a connector body axis 62. Low-voltage connector body 22 is attached to case 20 in a pivotal fashion in order to allow adjustment of the angle of inclination between connector body axis 62 and mounting boss axis 48 about a low-voltage connector body articulation axis 64 which is substantially perpendicular to connector body axis 62. In order to secure low-voltage connector body 22 to case 20, case 20 defines a case opening 66 within which a portion of low-voltage connector body 22 is received, thereby creating a clevis-like arrangement. Case opening 66 is defined by opposing parallel walls 66*a*, 66*b* between which low-voltage connector body 22 is received. Walls 66*a*, 66*b* may include wall protrusions 66*c*, 66*d* which extend inward from walls 66*a*, 66*b* respectively and are centered about low-voltage connector body articulation axis 64. Each wall protrusion 66*c*, 66*d* engages a respective connector body recess 22*a* of low-voltage connector body 22, thereby securing low-voltage connector body 22 to case 20 and allowing low-voltage connector body 22 to articulate relative to case 20 about low-voltage connector body articulation axis 64. Case 20 and low-voltage connector body 22 may be sized to provide a friction fit between case 20 and low-voltage connector body 22 which substantially prevents articulation of low-voltage connector body 22 relative to case 20 in operation of ignition coil 10, however, the friction fit allows a person that is installing ignition coil 10 on internal combustion engine 16 to position low-voltage connector body 22 relative to case 20 to a desired orientation by rotating low-voltage connector body 22 relative to case 20 about low-voltage connector body articulation axis 64. In addition to or in the alternative, as shown in FIG. 3, case 20 may include a plurality of case detents 20*a* which are each configured to receive a complementary connector body protrusion 22*b*. In this way, case detents 20*a* provide discrete positions to hold low-voltage connector body 22 relative to case 20. It should be understood that case detents 20*a* and connector body protrusion 22*b* may be reversed, that is, detents may be provided on low-voltage connector body 22 while a complementary protrusion may be provided on case 20.

High-voltage tower 24 includes a high-voltage tower upper portion 68 which is connected to case 20, for example by features of high-voltage tower upper portion 68 which interlock with case 20, by being molded as a single piece of plastic, by using fasteners, or by adhesives or combinations thereof. High-voltage tower upper portion 68 extends along an upper portion axis 70, which in the embodied example is coincident with mounting boss axis 48, however, in other examples, may be offset relative to mounting boss axis 48. High-voltage tower 24 also includes a high-voltage tower lower portion 72 which extends along a lower portion axis 74 such that high-voltage tower lower portion 72 is configured to allow lower portion axis 74 to articulate relative to upper portion axis 70. As embodied herein, high-voltage tower upper portion 68 defines an upper portion mating surface 68*a* which is oblique to upper portion axis 70 and abuts a lower portion mating surface 72*a* defined by high-voltage tower lower portion 72 such that lower portion mating surface 72*a* is oblique to lower portion axis 74. High-voltage tower lower portion 72 is configured to be rotatable relative to high-voltage tower upper portion 68 about upper portion axis 70; consequently, rotation of high-voltage tower lower portion 72 about upper portion axis 70 causes the angle of lower portion axis 74 to change relative to upper portion axis 70. In this way, upper portion mating surface 68*a* and lower portion mating surface 72*a* define a joint which allows articulation of high-voltage tower lower portion 72 relative to high-voltage tower upper portion 68. It should be noted that high-voltage conductor 44 is sufficiently compliant to accommodate the angular movement of high-voltage tower lower portion 72 relative to high-voltage tower upper portion 68.

Figure 5:
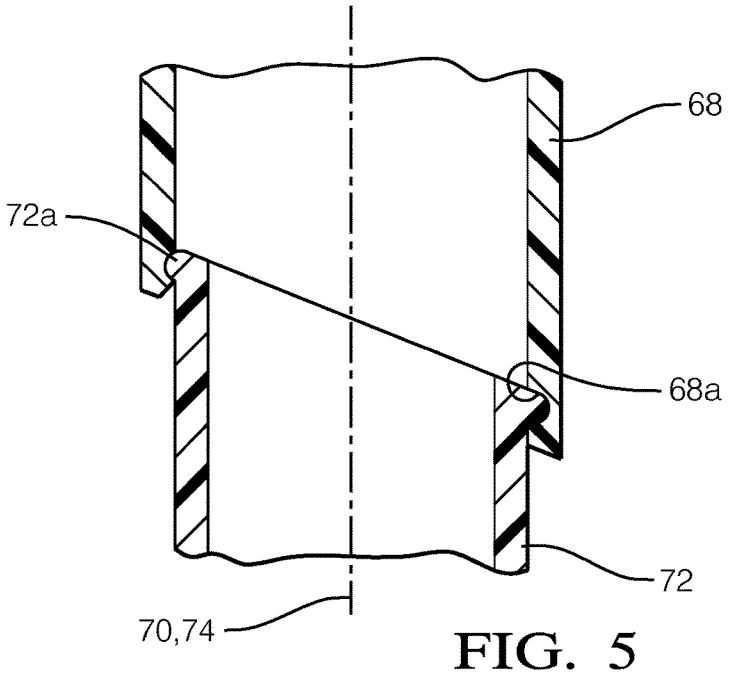
FIG. 5 is an enlarge view of a portion of FIG. 1.

With emphasis on FIG. 5, in order to retain high-voltage tower lower portion 72 to high-voltage tower upper portion 68 while allowing high-voltage tower lower portion 72 to rotate relative to high-voltage tower upper portion 68 about upper portion axis 70, upper portion mating surface 68*a* may be defined by a groove extending outward from the inside diameter of high-voltage tower upper portion 68 while lower portion mating surface 72*a* may be defined by a rib which extends outward from the outside diameter of high-voltage tower lower portion 72 and which is complementary to the groove which defines upper portion mating surface 68*a*. Consequently, when the rib which defines lower portion mating surface 72*a* engages the groove which defines upper portion mating surface 68*a*, high-voltage tower lower portion 72 is retained to high-voltage tower upper portion 68 while allowing high-voltage tower lower portion 72 to rotate relative to high-voltage tower upper portion 68 about upper portion axis 70. The rib which defines lower portion mating surface 72*a* and the groove which defines upper portion mating surface 68*a* may be sized to provide a friction fit between high-voltage tower upper portion 68 and high-voltage tower lower portion 72 which substantially prevents rotation of high-voltage tower lower portion 72 relative to high-voltage tower upper portion 68 about upper portion axis 70 in operation of ignition coil 10, however, the friction fit allows a person that is installing ignition coil 10 on internal combustion engine 16 to rotate high-voltage tower lower portion 72 relative to high-voltage tower upper portion 68 about upper portion axis 70 to achieve a desired angular relationship of lower portion axis 74 relative to upper portion axis 70. In addition to or in the alternative, high-voltage tower upper portion 68 and high-voltage tower lower portion 72 may be provided with complementary detents and protrusions similar to those described previously relative to case 20 and low-voltage connector body 22, thereby allowing discrete holding positions of high-voltage tower lower portion 72 relative to high-voltage tower upper portion 68.

High-voltage tower lower portion 72 is characterized by a fixed portion 72*c* and a telescoping portion 72*d* which allows high-voltage tower 24 to be adjustable in length. It should be noted that high-voltage conductor 44 is sufficiently compliant to accommodate the range of adjustability in the length of high-voltage tower 24. Fixed portion 72*c* engages high-voltage tower upper portion 68 while telescoping portion 72*d* engages spark plug 14. Fixed portion 72*c* defines detents illustrated as internal grooves 72*e* (only select internal grooves 72*e* have been labeled in the figures) which extend circumferentially about the inner perimeter of fixed portion 72*c* such that internal grooves 72*e* are spaced along lower portion axis 74. Telescoping portion 72*d* defines protrusions illustrated as external ribs 72*f* (only select external ribs 72*f* have been labeled in the figures) which extend circumferentially about the outer periphery of telescoping portion 72*d* such that external ribs 72*f* are spaced along lower portion axis 74. External ribs 72*f* are complementary to internal grooves 72*e* and telescoping portion 72*d* is sized to fit within fixed portion 72*c* such that external ribs 72*f* engage internal grooves 72*e*, thereby allowing telescoping portion 72*d* to be positioned at discrete locations along lower portion axis 74 to achieve a desired length of high-voltage tower 24. The quantity and spacing of external ribs 72*f* and internal grooves 72*e* may be selected to achieve a desired level of force required to adjust the axial position of telescoping portion 72*d* relative to fixed portion 72*c* and to achieve the desired magnitude of permissible axial movement of telescoping portion 72*d* relative to fixed portion 72*c*. It should be understood that, alternatively, fixed portion 72*c* may include internal ribs and telescoping portion 72*d* may have complementary external grooves. It should also be understood that, alternatively, fixed portion 72*c* may fit within telescoping portion 72*d*, and consequently, fixed portion 72*c* may include external features which are complementary to internal features of telescoping portion 72*d* in order to provide discrete positions of telescoping portion 72*d* relative to fixed portion 72*c* along lower portion axis 74. Also alternatively, internal grooves 72*e* and external ribs 72*f* may be omitted in order to provide infinite positions of telescoping portion 72*d* relative to fixed portion 72*c* along lower portion axis 74. When internal grooves 72*e* and external ribs 72*f* are omitted, fixed portion 72*c* and telescoping portion 72*d* may be sized to provide a friction fit therebetween which prevents movement of telescoping portion 72*d* relative to fixed portion 72*c* in operation of ignition coil 10.

It should now be apparent that ignition coil 10 accommodates different mounting environments. More specifically, rotation of mounting boss 26 relative to case 20 about mounting boss axis 48 allows for different geometric relationships between mounting boss 26 and low-voltage connector body 22. Rotation of mounting boss 26 relative to case 20 about mounting boss axis 48 also allows for different geometric relationships between mounting boss 26 and high-voltage tower 24, particularly when high-voltage tower lower portion 72 is adjusted to make lower portion axis 74 inclined relative to upper portion axis 70. Rotation of mounting boss 26 relative to case 20 may be permitted over an angular range of 360° or less than 360°, but preferably over an angular range of at least 90°. Also more specifically, articulation of low-voltage connector body 22 relative to case 20 about low-voltage connector body articulation axis 64 allows for different geometric relationships between low-voltage connector body 22 and case 20. Articulation of low-voltage connector body 22 relative to case 20 may preferably be permitted over an angular range of about 90°, but may alternatively be permitted over angular ranges that are greater than or less than 90°. Also more specifically, articulation of high-voltage tower 24 accommodates a mounting environment which requires an angulated high-voltage tower to mate with the spark plug of the internal combustion engine. High-voltage tower 24 may be allowed to articulate over an angular range of about 30°, but may alternatively be permitted over angular ranges that are greater than or less than 30°. Finally, high-voltage tower 24 being adjustable in length allows for ignition coil 10 to accommodate mounting environments having different spacing between mounting boss 26 and spark plug 14. High-voltage tower 24 may be adjustable over a range of about 25 mm, but may be adjustable over ranges of greater than or less than 25 mm. In consequence of the aforementioned adjustments, ignition coil 10 may be substituted for a number of other ignition coils which include the same circuit 18 but may have different geometrical relationships between the mounting boss, the low-voltage connector body, and the high-voltage tower. Since ignition coil 10 can be substituted for a number of other ignition coils, the inventory in a service environment can be minimized, thereby saving storage space and reducing overhead for maintaining inventory.

While this invention has been described in terms of preferred embodiments thereof, it is not intended to be so limited, but rather only to the extent set forth in the claims that follow.

We claim:

1. An ignition coil for delivering a spark-generating current to a spark plug; said ignition coil comprising:

a circuit which generates said spark-generating current;

a case within which said circuit is disposed; and a mounting boss attached to said case such that said mounting boss is rotatable relative to said case about a mounting boss axis, said mounting boss being configured to mount said ignition coil.

2. An ignition coil as in claim 1 wherein said case includes a case pivot having a constant radius centered about said mounting boss axis and said mounting boss includes a mounting boss pivot having a constant radius and centered about said mounting boss axis such that said mounting boss pivot engages said case pivot.

3. An ignition coil as in claim 2 wherein said case pivot is cylindrical.

4. An ignition coil as in claim 3 wherein said mounting boss pivot is cylindrical.

5. An ignition coil as in claim 1 further comprising means for holding said mounting boss relative to said case at discrete positions.

6. An ignition coil as in claim 1 further comprising a connector body which houses an electrical terminal which is in electrical communication with said circuit, said connector body being attached to said case such that said connector body articulates relative to said case about a connector body articulation axis.

7. An ignition coil as in claim 6 wherein said case includes a case opening defining a pair of opposing walls such that a portion of said connector body is located between said opposing walls.

8. An ignition coil as in claim 7 wherein said opposing walls include wall protrusions centered about said connector body articulation axis and said connector body includes complementary recesses centered about said connector body articulation axis such that said recesses engage said wall protrusions.

9. An ignition coil as in claim 7 further comprising means for holding said connector body relative to said case at discrete positions.

10. An ignition coil as in claim 1 further comprising a high-voltage tower having a high-voltage tower upper portion attached to said case and extending along an upper portion axis, said high-voltage tower also having a high-voltage tower lower portion configured to engage said spark plug and extending from said high-voltage tower upper portion along a lower portion axis, said high-voltage tower upper portion being attached to said high-voltage tower lower portion by a joint which allows said lower portion axis to articulate relative to said upper portion axis.

11. An ignition coil as in claim 10 wherein:

said high-voltage tower upper portion defines an upper portion mating surface which is oblique to said upper portion axis;

said high-voltage tower lower portion defines a lower portion mating surface which is oblique to said lower portion axis and which mates with said upper portion mating surface;

and said high-voltage tower lower portion is rotatable about said upper portion axis such that rotation of said high-voltage tower lower portion about said upper portion axis causes said lower portion axis to articulate relative to said upper portion axis.

12. An ignition coil as in claim 1 further comprising a high-voltage tower extending from said case and configured to engage said spark plug, said high-voltage tower having a fixed portion and a telescoping portion such that said fixed portion and said telescoping portion extend along a tower axis and such that said telescoping portion is configured to slide relative to said fixed portion along said tower axis.

13. An ignition coil as in claim 12 further comprising means for means for holding said telescoping portion relative to said fixed portion at discrete positions.

14. An ignition coil as in claim 1 further comprising:

a connector body which houses an electrical terminal which is in electrical communication with said circuit, said connector body being attached to said case such that said connector body articulates relative to said case about a connector body articulation axis; and a high-voltage tower extending from said case and configured to engage said spark plug, said high-voltage tower having a fixed portion and a telescoping portion such that said fixed portion and said telescoping portion extend along a tower axis and such that said telescoping portion is configured to slide relative to said fixed portion along said tower axis.

15. An ignition coil as in claim 14 further comprising:

means for holding said mounting boss relative to said case at discrete positions; and means for holding said connector body relative to said case at discrete positions.

16. An ignition coil as in claim 1 further comprising:

a connector body which houses an electrical terminal which is in electrical communication with said circuit, said connector body being attached to said case such that said connector body articulates relative to said case about a connector body articulation axis; and a high-voltage tower having a high-voltage tower upper portion attached to said case and extending along an upper portion axis, said high-voltage tower also having a high-voltage tower lower portion configured to engage said spark plug and extending from said high-voltage tower upper portion along a lower portion axis, said high-voltage tower upper portion being attached to said high-voltage tower lower portion by a joint which allows said lower portion axis to articulate relative to said upper portion axis;

wherein said high-voltage tower lower portion defines a fixed portion and a telescoping portion such that said telescoping portion is configured to slide relative to said fixed portion along said lower portion axis.

17. An ignition coil as in claim 16 further comprising:

means for holding said mounting boss relative to said case at discrete positions;

means for holding said connector body relative to said case at discrete positions; and means for holding said telescoping portion relative to said fixed portion at discrete positions.

18. An ignition coil as in claim 1 wherein said mounting boss includes a aperture therethrough configured to receive a fastener to mount said ignition coil.

19. An ignition coil as in claim 18 wherein said aperture is elongated in a radial direction from said mounting boss axis.

20. An ignition coil for delivering a spark-generating current to a spark plug; said ignition coil comprising:

a circuit which generates said spark-generating current;

a case within which said circuit is disposed;

a connector body which houses an electrical terminal which is in electrical communication with said circuit, said connector body being attached to said case such that said connector body articulates relative to said case about a connector body articulation axis.

21. An ignition coil as in claim 20 wherein said case includes a case opening defining a pair of opposing walls such that a portion of said connector body is located between said opposing walls.

22. An ignition coil as in claim 21 wherein said opposing walls include wall protrusions centered about said connector body articulation axis and said connector body includes complementary recesses centered about said connector body articulation axis such that said recesses engage said wall protrusions.

23. An ignition coil as in claim 21 further comprising means for holding said connector body relative to said case at discrete positions.

24. An ignition coil for delivering a spark-generating current to a spark plug; said ignition coil comprising:

a circuit which generates said spark-generating current;

a case within which said circuit is disposed;

comprising a high-voltage tower extending from said case and configured to engage said spark plug, said high-voltage tower having a fixed portion and a telescoping portion such that said fixed portion and said telescoping portion extend along a tower axis and such that said telescoping portion is configured to slide relative to said fixed portion along said tower axis.

25. An ignition coil as in claim 24 further comprising means for means for holding said telescoping portion relative to said fixed portion at discrete positions.

* * * * *